United States Patent [19]

Virr et al.

[11] 3,970,011

[45] July 20, 1976

[54] COMBUSTION WITH FLUIDIZABLE BED

[75] Inventors: Michael John Virr, Stourbridge; Douglas Ernest Elliott, Sutton Coldfield, both of England

[73] Assignee: Fluidfire Development Limited, England

[22] Filed: Feb. 4, 1975

[21] Appl. No.: 546,943

[52] U.S. Cl. ..... 110/8 F; 110/28 J

[51] Int. Cl.[2] ..... F23G 5/00

[58] Field of Search ..... 110/8 R, 8 F, 28 J; 122/4 D

[56] References Cited

UNITED STATES PATENTS

| | | | |
|---|---|---|---|
| 2,876,079 | 3/1959 | Upchurch et al. | 110/28 |
| 3,119,379 | 1/1964 | Sweeney | 110/28 |
| 3,589,313 | 6/1971 | Smith et al. | 110/8 |
| 3,702,595 | 11/1972 | Muirhead et al. | 110/8 |
| 3,881,857 | 5/1975 | Hoy et al. | 110/28 |
| 3,884,617 | 5/1975 | Virr | 110/28 |

*Primary Examiner*—Kenneth W. Sprague
*Attorney, Agent, or Firm*—Holman & Stern

[57] ABSTRACT

A furnace for carrying out combustion of refuse or for reclaiming particles contaminated with combustible material comprises a bed of particles which is fluidized by feeding air and gaseous fuel into the bed. The refuse or contaminated material is fed into the bed and it is heated by combustion of the fuel therein. Incombustible residue is discharged from the bed over a weir. The furnace includes a heat exchanger for extracting heat from a part of the bed which can be fluidized selectively.

12 Claims, 5 Drawing Figures

COMBUSTION WITH FLUIDIZABLE BED

BACKGROUND OF THE INVENTION

This invention relates to apparatus in which combustible material is burned in a fluidised bed.

It is an object of the invention to provide apparatus suitable for burning in a fluidised bed a non-gaseous combustible material which produces a solid incombustible residue.

One problem which arises when non-gaseous combustible material is to be burned in a fluidised bed is that of raising the temperature of the bed to the minimum temperature at which combustion of the material can occur.

SUMMARY OF THE INVENTION

According to the present invention there is provided apparatus comprising a combustion chamber, a support adapted to support a bed of particles in the combustion chamber and to admit gas to the bed so that the bed can be fluidised, first discharge means for discharging non-gaseous material into the bed, second discharge means for discharging solids from the bed and feed means for mixing a gaseous fuel and air and feeding the mixture into the bed through said support at a rate such as to fluidise at least a part of the bed.

With apparatus in accordance with the invention, the temperature of the bed can be raised by feeding a mixture of gaseous fuel and air into the bed and igniting the mixture in the combustion chamber. Initially, the gaseous fuel will burn above the bed and impart heat to the bed. As the temperature of the bed rises, combustion will spread into the bed. The feeding of a gaseous mixture of fuel and air into the bed enables complete combustion of the fuel to be ensured of suitable proportions of gaseous fuel and air, without any necessity for feeding a large excess of air into the bed with the fuel.

The apparatus may further comprise a passageway through which the gaseous mixture flows to the support, the support forming one boundary of the passageway and a wall of thermally-conductive material forming an opposite boundary so that heat can be extracted from the passageway through said wall. The wall may be provided with fins which project away from the passageway and means may be provided for directing a fluid coolant over the fins.

This arrangement reduces the risk of combustion of the fuel occurring prematurely, i.e. before the gaseous mixture of fuel and air has passed into the bed through the support.

The apparatus may be so arranged that, when the bed is fluidised by gas fed into the bed through the support, a general flow of particles is established along a circulatory path.

Such a general flow of particles assists distribution of the non-gaseous combustible material throughout the bed and reduces the risk of a part of the bed becoming substantially cooler than the remainder of the bed. Thus, the combustible material discharged into the bed by the first discharge means may be wet, partly combustible material such as refuse.

BRIEF DESCRIPTION OF THE DRAWINGS

The invention will now be described by way of example with reference to the accompanying drawings, wherein.

DETAILED DESCRIPTION

Figure 1:
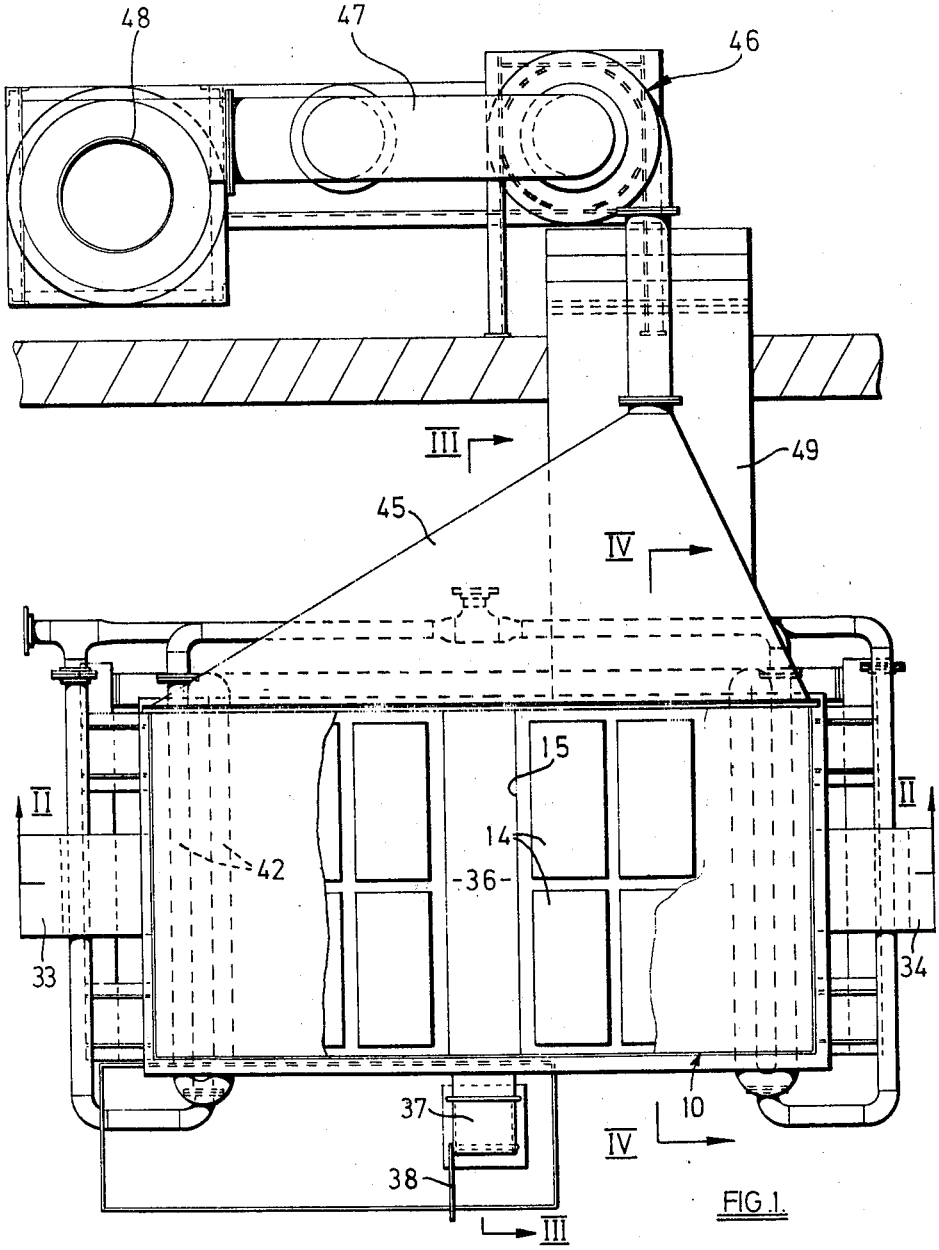
FIG. 1 shows in plan view one form of apparatus in accordance with the invention, a roof of a combustion chamber being broken away and first discharge means which extends through the roof being omitted to reveal parts within the combustion chamber.
Figure 2:
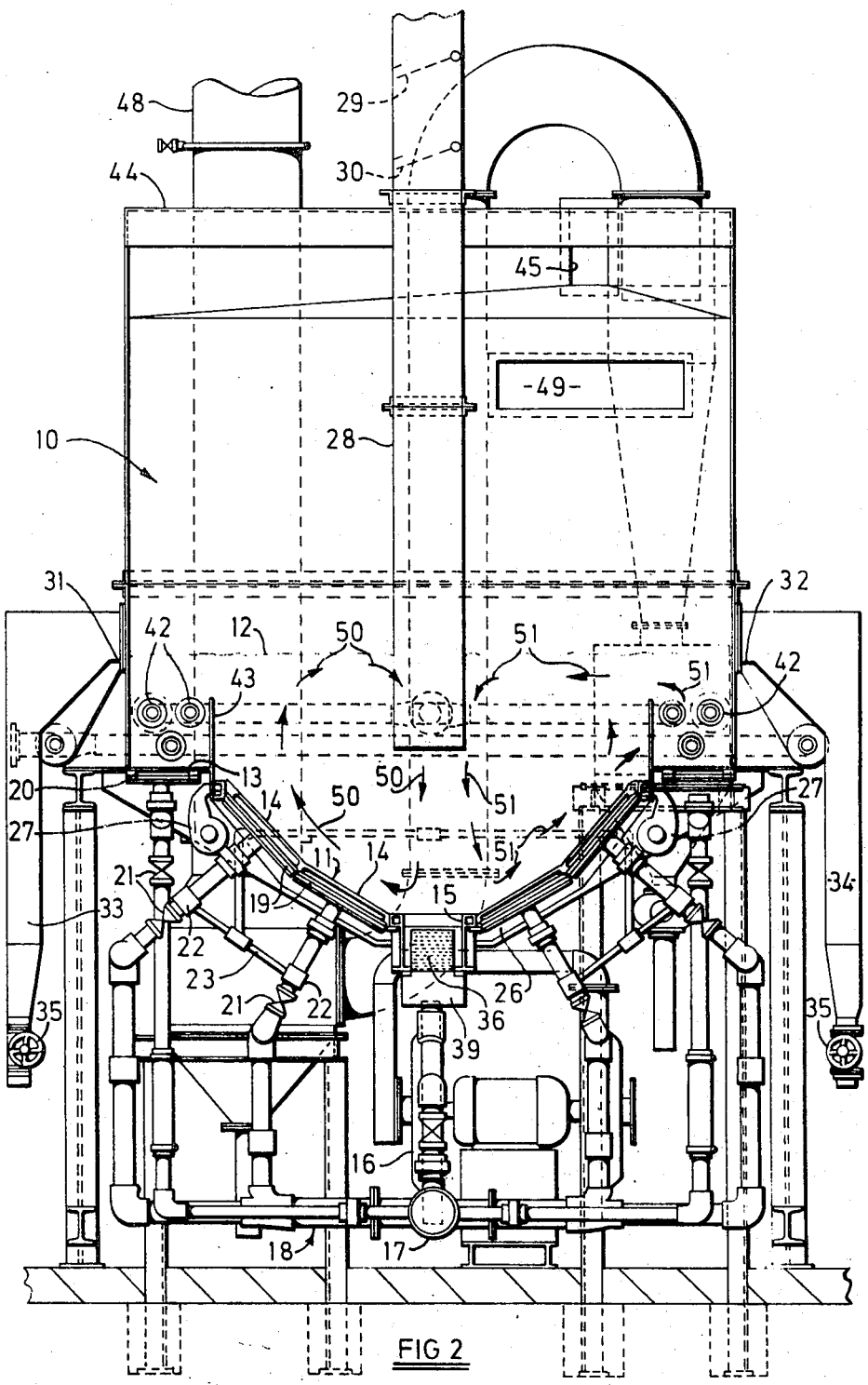
FIG. 2 is a sectional view on the line II—II of FIG. 1.

The apparatus of FIGS. 1 to 4 comprises a combustion chamber 10 of rectangular shape as viewed in plan. The bottom of the combustion chamber is defined by a support indicated generally at 11 which is previous to gases and is adapted to support a bed of particles within the combustion chamber. The bed of particles is omitted from FIG. 1 for clarity and the surface of the bed is indicated in FIG. 2 at 12. When the apparatus is first brought into operation, the bed may consist of refactory particles such as silica sand.

In the example of apparatus illustrated in FIGS. 1 to 4, the support 11 comprises four stainless steel plates 13 which have been pierced to form small apertures such that gases can pass through the plates but the solid particles of the bed can be supported by the plates. These plates are horizontal and disposed adjacent to opposite ends of the combustion chamber, there being one pair of plates arranged side-by-side adjacent to each end of the combustion chamber. The support 11 further comprises eight porous ceramic tiles 14 which are arranged to slope downwardly from the horizontal plates 13 to a central opening 15 which is defined by a horizontal rectangular frame. As viewed in side elevation, the sloping tiles 14 present towards the bed of particles an approximation to a concave, part-cylindrical surface. Whilst an approximately curved surface formed of flat tiles is preferred, it would be within the scope of the invention to provide a support comprising one or more curved, gas-permeable members, the concave face of which is presented towards the bed.

Means is provided for feeding a mixture of a gaseous fuel and air into the combustion chamber through the tiles 14 of the support and for feeding air into the combustion chamber through the horizontal plates 13. This feed means comprises a fan 16 which is arranged to blow air into a main air duct 17. A branched distribution duct 18 leads from the main air duct to respective passageways 19 associated one with each sloping tile 14 and passageways 20 associated one with each horizontal plate 13. Each of the passageways 19 and 20 is served by an individual branch of the distribution duct, which branch includes a control valve 21 indicated diagrammatically in the drawings. Those branches which serve the passageways 19 each include a gas mixing device 22 interposed between the passageway 19 and the associated control valve 21. The gas mixing devices 22 are adapted to inject into air flowing along the branch of the distribution duct a gaseous fuel supplied through a fuel gas pipe 23. Whilst we prefer to use a fuel which is gaseous at normal temperatures, it would be within the scope of the invention to mix with the air the vapour of a liquid fuel.

One boundary of each of the passageways 19 is formed by the downwardly-presented face of the associated sloping tile 14. As will be described hereinafter, when the apparatus is in use combustion occurs within the bed of particles and accordingly heat will be imparted to each of the sloping tiles. As a mixture of a gaseous fuel and air is fed to the passageway immediately beneath each sloping tile, it is important to avoid the temperature of the mixture within each of the passageways 19 rising to a value at which combustion can occur, since such premature combustion would damage the apparatus. Accordingly, cooling means is provided for cooling the gases flowing through each of the passageways 19. A boundary of each passageway opposite to the associated tile 14 is formed by a wall 24 of metal, such wall therefore being a relatively good conductor of heat. At that face of the wall 24 which is presented away from the passageway 19 there is provided a plurality of fins 25 which are in thermal communication with the wall. The fins project into a coolant duct 26, shown most clearly in FIG. 4, through which a fluid coolant, for example air, can be caused to flow by means such as a fan 52. The coolant duct has an outlet opening 53 remote from the fan 52.

A further coolant duct 53 extends around the periphery of that part of the support 11 which is constituted by the sloping tiles 14. Cooling air is blown through this duct by fans 27.

In order to reduce further the risk of combustion of the gaseous fuel occurring within the passageways 19, the depth of each of these passageways, i.e. the distance between the wall 24 and the tile 14, is as small as is consistent with substantially unhindered flow of the gaseous mixture from the associated branch of the distribution duct 18 to all parts of the tile. Thus, the volume of each passageway 19 is small and the residence time of the gaseous mixture therein is brief. The shallow depth of each passageway 19 also ensures that the gases flowing therethrough have a fairly high velocity. The gas velocity may be greater than the flame speed in the mixture so that combustion cannot spread into the passageway from the tile.

In cases where the maximum temperatures reached by the bed is intended to be below 1,000°C, the fins 25 may be omitted.

The apparatus further comprises first discharge means for discharging solid combustible material into the combustion chamber. This discharge means comprises a vertical chute which extends down the centre of the combustion chamber. The open lower end of the chute is disposed below the surface 12 of the bed of refactory particles but at a position well above the central opening 15. The chute 28 contains two flap valves indicated diagrammatically in FIG. 2 at 29 and 30 and is connected at its upper end with a hoper or other suitable means for receiving material which is to be burned in the apparatus. The flap valves permit such solid material to be admitted to the combustion without the chute 28 being open throughout its length.

The apparatus further includes second discharge means for discharging solids from the bed within the combustion chamber. This second discharge means comprises two weirs arranged one at each end of the combustion chamber and leading to respective discharge chutes 33, 34 disposed outside the combustion chamber. At the lower end of each discharge chute there is provided a valve 35 which can be opened periodically to permit solid matter which has collected in the associated discharge chute to fall out.

The apparatus further includes third discharge means for discharging large lumps of solid matter from the combustion chamber. This third discharge means comprises a passageway having an inclined floor 36 which slopes downwardly from the central opening 15 at the bottom of the combustion chamber to a vertical passageway 37 containing two flap valves 38 disposed one above the other. The sloping floor 36 is formed of perforated sheet metal or is otherwise adapted to be permeable to air but to support the refactory particles of the bed. Beneath the floor 36 is a plenum chamber 39 connected by a duct 40 with the main air duct 17. The duct 40 includes a control valve 41, which normally prevents air being fed into the bed through the floor 36.

A heat exchanger assembly is provided for extracting heat from the bed of refactory particles. This assembly comprises a plurality of finned tubes which are immersed in the bed and are disposed some adjacent to each end of the combustion chamber 10 so that the heat exchanger tubes lie directly above the horizontal tiles 13. Those parts of the bed which contain the heat exchanger tubes 43 are partly separated from the remainder of the bed by vertical partitions 43, the lower end of each partition being situated between the associated horizontal tiles 13 and the adjacent sloping tiles 14. The upper edge of each of the partitions 43 is situated at a level well below the surface 12 of the bed and a lower part of each partition is formed with apertures through which particles of the bed, when fluidised, can flow. The tubes 42 would normally contain water and would be connected with a pump whereby water can be circulated through the tubes 42 to a point of use.

The combustion chamber is closed by a roof 44 and communicates near to the roof with a gas outlet 46 which leads to a cyclone 46. From the cyclone a flue 47 leads to a chimney 48 which may contain a water spray. The combustion chamber also communicates with a safety duct 49, the outer end of which is normally closed by a closure member which is biased into the closed position so that in the event of an excessive increase of pressure within the combustion chamber the safety duct will be opened to release gases from the combustion chamber.

Operation of the apparatus will now be described. In order to start the apparatus from cold, the fans 16 and 27 are driven, the valves 21 associated with the sloping passageways 19 are opened and gaseous fuel is mixed with the air flowing into these passageways so that a gaseous combustible mixture is fed into the combustion chamber through the sloping tiles 14. The gas velocity may be just sufficient to fluidise those parts of the bed which are directly above the sloping tiles 14. The gaseous mixture rises to the surface 12 of the bed and is there ignited by means not shown in the accompanying drawings. Combustion initially occurs at the surface of the bed and heat is thereby imparted to the bed. As the temperature of the bed rises, combustion spreads downwardly into the bed. When the normal operating temperature is reached, combustion of the gaseous fuel takes place entirely within a lower part of the bed near to the sloping tiles 14.

During this initial stage of operation, no air is supplied to the bed through the horizontal tiles 13 and accordingly those parts of the bed which are separated by the partitions 43 are not fluidised. The masses of stationary particles surrounding the heat exchanger tubes 42 act as an efficient thermal insulator and thereby prevent any significant flow of heat to these tubes from those parts of the bed in which combustion is occurring. Also during the initial stage of operation, no air is fed to the plenum chamber 39 so that a central part of the bed remains slumped. The density of the bed will vary, being greatest in the slumped parts of the bed and lowest in the fluidised parts. Accordingly, there will be a tendency for particles to rise in the fluidised parts of the bed and to descend in the slumped parts. As the temperature of the bed is increased to the normal operating temperature, flow of particles along a circulatory path as indicated by the arrows 50 in FIG. 2 will be established. It will be noted that this circulatory path includes a descending portion at the centre of the bed and an ascending portion above the sloping tiles 14. No part of the circulatory path lies above the horizontal tiles 13 since the partitions 43 prevent the flow of slumped particles into the fluidised parts of the bed.

When the normal operating temperature of the bed has been reached, admission of solid combustible material, for example pulverised refuse, to the combustion chamber 10 can be commenced. The flap valves 29 and 30 are opened alternately so that only one of these valves is open at any one time. Refuse falls down the chute 28 into the centre of the bed, i.e. into the descending part of the circulatory path. Accordingly, refuse introduced into the bed is carried downwardly and then towards one end of the bed before being permitted to rise to the surface 12. Light material, for example paper, is submerged within the bed for a period sufficient to ensure that such light material is burned completely before reaching the surface of the bed. Larger pieces of solid combustible material may reach the surface of the bed before they are completely burned, but such relatively heavy pieces of material will not be carried upwardly from the bed by the exhaust gases passing to the gas outlet 45.

Sufficient air is admitted to the bed through the sloping tiles 14 to burn the solid combustible material completely. Depending upon the nature of the material admitted through the chute 28, the supply of gaseous fuel to the bed may be reduced or terminated. If the calorific value of the material introduced through the chute 28 is sufficiently high, the temperature of the bed may tend to rise notwithstanding that supply of the gaseous fuel is terminated. A substantial rise in temperature is undesirable as it would lead to excessive sintering of incombustible material. To avoid such a rise in the temperature of the bed, air is admitted to the bed through the horizontal tiles 13 to fluidise the end portions of the bed. Circulation of the particles of the bed then follows the paths indicated by the arrows 51 in the right-hand half of FIG. 2. It will be noted that when the end parts of the bed are fluidised, the circulatory path extends through these end parts and accordingly heat is transferred to the heat exchanger tubes 42 by the circulating particles.

As incombustible material accumulates in the bed, particles will overflow at the weirs 31 and 32 so that the level of the surface 12 does not rise. The temperature of the bed would normally be maintained at a value below that temperature at which the ash resulting from combustion of the solid material sinters readily. Means may be provided for sensing the temperature of the bed and for controlling operation of the flap valves and conveyor associated with the chute 28 in accordance with the temperature of the bed to maintain said temperature near to a selected value. The particular operating temperature selected will depend upon the nature of the solid combustible material which is to be consumed.

When material such as refuse is burned, it is inevitable that some large lumps of incombustible material will remain, such lumps either being present in the refuse fed to the combustion chamber or formed by sintering. Such lumps will accumulate at the bottom of the descending part of the circulatory path in the bed, i.e. within the central opening 15. Periodically the valve 41 is opened to admit air at a relatively high rate to the plenum chamber 39 whence it flows through the floor 36 to fluidise the small particles lying above the floor 36 and within the opening 15. This enables the larger lumps to sink through the fluidised particles to the lower end of the sloping floor 36 and to enter the vertical passage 37, whence they can be discharged through the flap valves 38. The valve 41 is then closed once more.

It will be appreciated that the particles of which the bed is initially composed will gradually be lost over the weirs 31 and 32 and through the vertical passage 37. The bed may eventually be composed entirely of ash produced by combustion of solid material within the bed.

The circulation of particles within the bed ensures that material introduced through the chute 28 is rapidly distributed throughout the bed, thereby avoiding large variations in temperature as between one part of the bed and another part. Wet refuse can readily be consumed in the apparatus.

Figure 3:
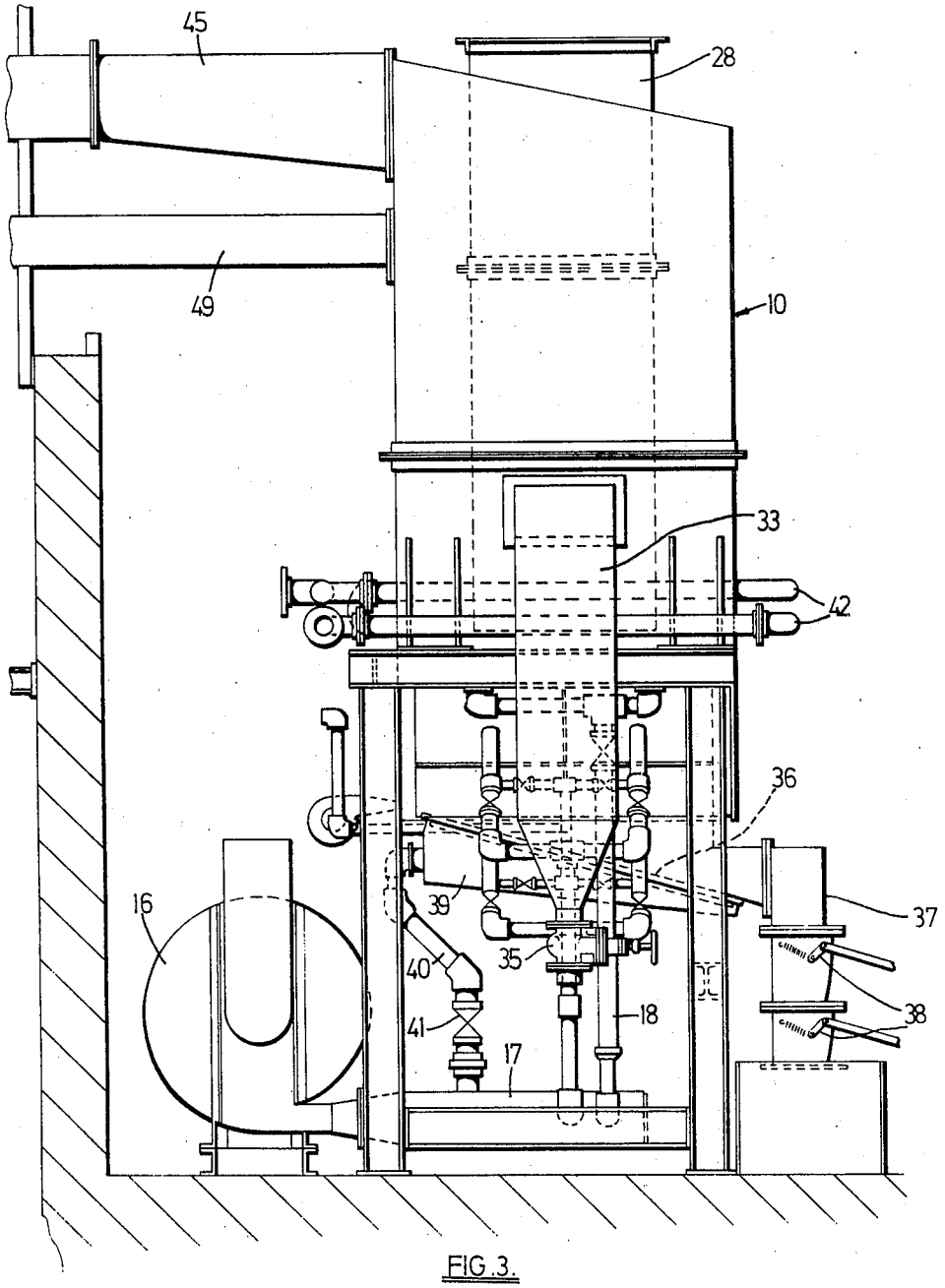
FIG. 3 is a fragmentary view in side elevation and partly in cross-section on the line III—III of FIG. 1.
Figure 4:
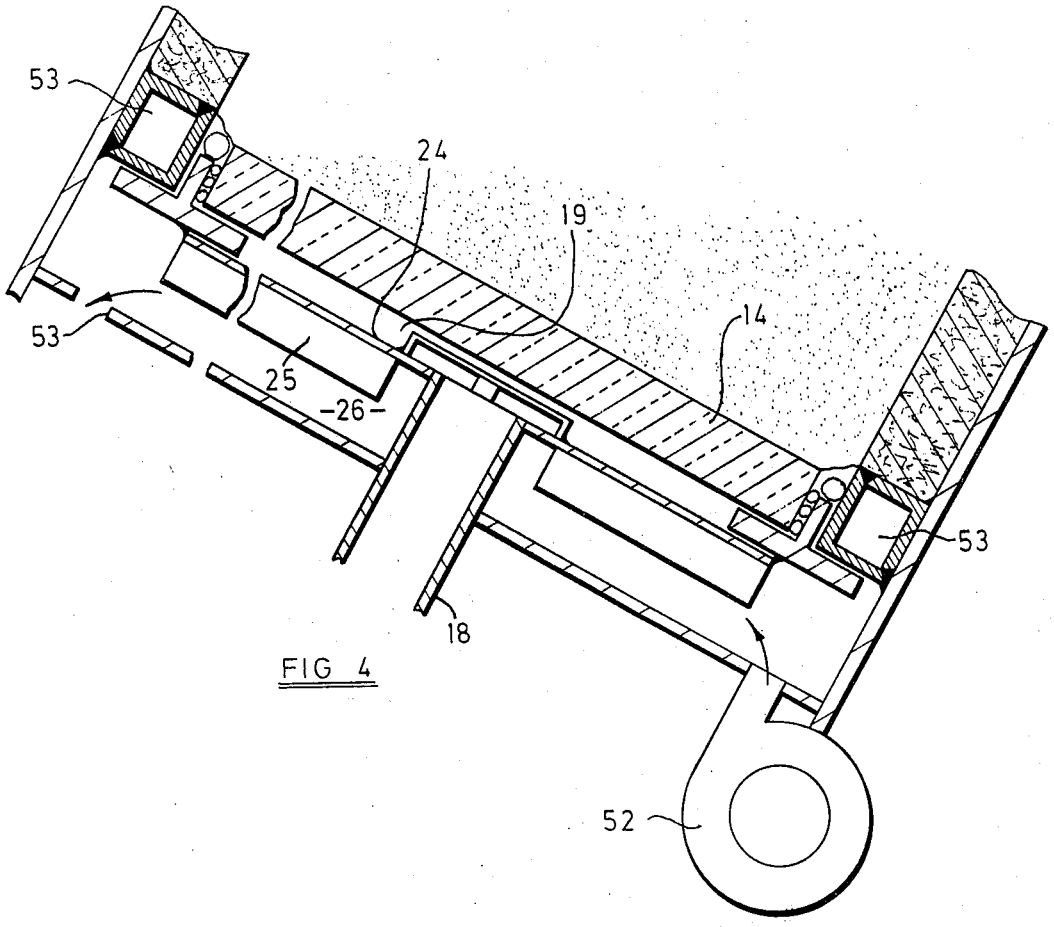
FIG. 4 is a fragmentary view on an enlarged scale in cross-section on the line IV—IV of FIG. 1.

The apparatus illustrated in FIGS. 1 to 3 may also be used for burning sewage cake, sewage sludge, graphite particles, cryolite contaminated with carbon, foundry moulding sand contaminated with resin binders, colliery waste, coal sludge, lignites and high ash content coals. In a case where combustion of the material to be consumed in the apparatus does not release sufficient heat for the temperature of the bed to be maintained, gaseous fuel may be supplied through the sloping tiles 14 from the fuel gas pipe 23. For example, if unusually wet refuse is discharged inro the bed, thereby reducing the bed temperature, a temperature sensor associated with the bed may operate to initiate the supply of gaseous fuel until the normal operating temperature of the bed is regained.

It is intended that approximately one half of the heat released by combustion of the solid material should be extracted by means of the heat exchanger tubes 42. If required, a further heat exchanger may be installed in the flue 47 between the cyclone 46 and the chimney 48. Such heat exchanger may be arranged to extract from the exhaust gases an amount of heat equal to approximately one quarter of the heat released by combustion of the solid material. When such additional heat exchanger is provided, a fan may be provided downstream of the further heat exchanger to draw gases through the heat exchanger and discharge them into the chimney 48. The temperature of the exhaust gases discharged to the chimney may be in the range 200° to 300°C.

The heat exchanger tubes 42 are typically of 3 inch outside diameter bearing external fins so that the diameter over the fins is approximately 5 inches. The fins may be ⅛ inch thick and spaced apart by a distance within the range ⅛ inch to ¼ inch. The tubes and fins are preferably formed of stainless steel. It will be noted that the heat exchanger tubes are remote from the position at which solid combustible material is discharged into the bed. Accordingly, the combustible material is largely burned before it can be carried into the vicinity of the heat exchanger tubes. This arrangement reduces the risk of incombustible material adhering to the heat exchanger tubes or blocking the gaps between the fins thereof.

Water heated in the heat exchanger tubes 42 may be used for heating buildings, for example being fed to heating systems thereof. Alternatively, the heat exchanger assembly may be arranged to generate steam which can then be used to drive a turbine.

Figure 5:
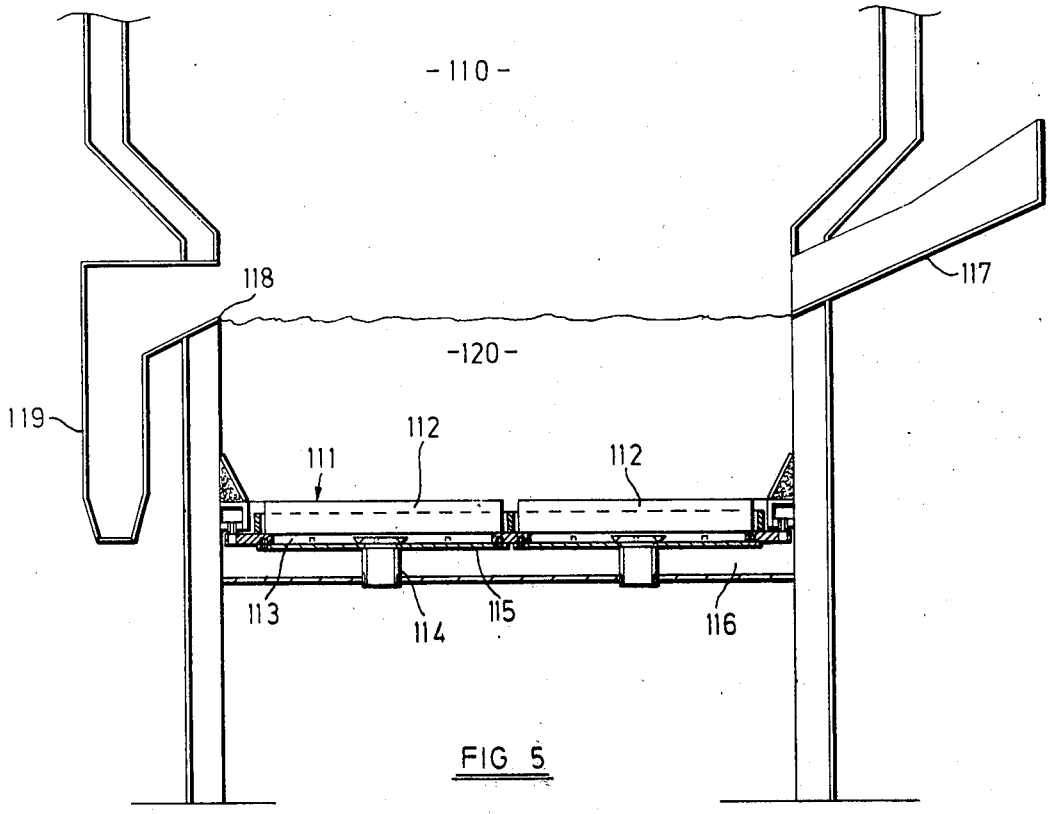
FIG. 5 is a cross-sectional view of a further form of apparatus in accordance with the invention.

In FIG. 5 there is illustrated apparatus in accordance with the invention which is intended for the reclamation of particles contaminated with combustible material, for example foundry moulding sand contaminated with resin binders.

The apparatus comprises a combustion chamber which is rectangular, as viewed in plan, and is closed at its upper side except for a gas outlet (not shown). The bottom of the combustion is defined by a horizontal support 111 comprising a plurality of horizontal porous ceramic tiles.

Beneath each tile 112 there is a shallow passageway 113 with which there communicates at a position immediately below the centre of the tile a feed duct 114 along which a gaseous mixture of fuel and air is fed to the passageway from a gas mixing device (not shown). Air and a gaseous fuel are fed separately to the gas mixing device.

A wall 115 of each passageway 113 which forms a boundary thereof opposite to the tile 112 is formed of metal and is therefore a relatively good conductor of heat. The wall 115 also forms the upper boundary of a coolant duct 116 along which air or some other coolant is forced by a suitable pump (not shown). The wall 115 may be provided with fins which project into the coolant duct.

First discharge means in the form of an inclined chute 117 is provided for discharging contaminated particles into the combustion chamber at one end thereof. At the opposite end of the combustion chamber there is a second discharge means in the form of a weir 118 over which particles can pass from the combustion chamber into a discharge chute 119. The particles to be treated in the apparatus are discharged into the combustion chamber through the chute 117 to form a bed 120 of particles on the support 111. When the bed is fluidised, the surface of the bed remains at the same level as the weir 118.

When the apparatus is started from cold, no particles are introduced through the chute 117. A mixture of a gaseous fuel and air is fed to each of the passageways 113 and flows therefrom through the associated tile 112 into the bed. The rate at which the gaseous mixture is fed is preferably just sufficient to fluidise the bed. The depth of the passageway 113 is small so that the gas velocity within this passageway will be fairly high. The gas velocity in the passageway 113 may exceed the flame speed in the gaseous mixture.

The gaseous mixture is ignited in the combustion chamber 110 above the bed 120. Initially, combustion occurs above the bed but as the latter becomes heated combustion spreads downwardly into the bed. When the normal operating temperature has been reached, particles of foundry moulding sand contaminated with resin binders are discharged into the bed down the chute 117. As the entire bed is fluidised, these particles are rapidly dispersed throughout the bed. Particles flow over the weir 118 from the bed into the discharge chute 119. The length of the bed is selected to provide a minimum residence time of particles within the bed which is sufficient to ensure that all of the combustible material is burned from the particles. Sufficient air is introduced through the tiles 112 to permit complete combustion of the combustible material on the particles.

If the particles carry sufficient combustible material for the heat released by combustion to be sufficient to raise the temperature of the particles to the operating temperature of the bed, the supply of gaseous fuel to the bed may be reduced or terminated. The rate of supply of gaseous fuel or the rate of discharge of particles into the bed may be controlled by control means including a temperature sensor for sensing the temperature of the bed, the control means operating to maintain the bed at a predetermined temperature.

The apparatus illustrated in FIG. 5 may also be used to burn graphite or to burn oil off swarf. In such cases, we prefer to charge the combustion chamber with a bed of an inert dense material, for example sand or aluminium oxide, and to introduce the material to be burned into this bed.

We claim:

1. Apparatus comprising:

a. a combustion chamber, b. a support adapted to support a bed of particles in the combustion chamber and to admit gas to the bed so that the bed can be fluidised, c. first discharge means for discharging nongaseous material into the bed, d. second discharge means in the form of a weir for discharging solids from the bed, e. third discharge means for discharging from the bottom of the bed solid material which does not fluidise, and f. feed means for mixing a gaseous fuel and air and feeding the mixture into the bed through said support at a rate such as to fluidise at least a part of the bed.

2. Apparatus according to claim 1 wherein said third discharge means includes means defining an opening at the bottom of the bed and a floor which slopes downwardly from said opening and which is adapted to admit a gas to the bed, and wherein said feed means includes means for feeding the gas through said sloping floor into the bed, whereby fluidisable particles supported on the sloping floor can be fluidised.

3. Apparatus according to claim 1 wherein said third discharge means defines a passageway which extends downwardly towards an outlet for solid material which does not fluidise and a boundary of the passageway is formed by a part of the support through which fluidising gas can be admitted selectively, the apparatus further comprising control means for controlling flow of fluidising gas through said part of the support, whereby particles within the passageway can be fluidised by admitting fluidising gas through said part of the support to permit movement down the passageway of the solid material material which does not fluidise.

4. Apparatus comprising:

a. a combustion chamber, b. a support adapted to support a bed of particles in the combustion chamber and to admit gas to the bed so that the bed can be fluidised, c. first discharge means for discharging non-gaseous material into the bed, d. second discharge means for discharging solids from the bed, e. feed means for mixing a gaseous fuel and air and feeding the mixture into the bed through said support at a rate such as to fluidise at least a part of the bed, said support includes a portion beneath the heat exchanger assembly, a part of the bed is supported on said portion of the support, said portion of the support is adapted to admit a gas to said part of the bed, the feed means includes means for selectively feeding a gas through said portion of the support into said part of the bed to fluidise same, and the heat exchanger assembly is submerged in said part of the bed, at least when said part is fluidised, whereby said part of the bed in which the heat exchanger assembly is submerged can be fluidised selectively to carry heat to the heat exchanger assembly.

5. Apparatus according to claim 4 wherein said heat exchanger assembly is remote from the position at which the first discharge means discharges material into the bed.

6. Apparatus comprising:

a. a combustion chamber, b. a support adapted to support a bed of particles in the combustion chamber and to admit gas to the bed so that the bed can be fluidised, c. first discharge means for discharging nongaseous material into the bed, d. second discharge means for discharging solids from the bed, e. feed means for mixing a gaseous fuel and air and feeding the mixture into the bed through said support at a rate such as to fluidise at least a part of the bed, f. a heat exchanger assembly submerged in a part of the bed, and g. means for selectively preventing fluidisation of said part of the bed in which the heat exchanger assembly is submerged, whereby transmission of heat to the heat exchanger assembly by the particles of the bed can be controlled.

7. Apparatus comprising:

a. a combustion chamber, b. a support adapted to support a bed of particles in the combustion chamber and to admit gas to the bed so that at least a part of the bed can be fluidised, c. first discharge means for discharging non-gaseous material into the bed, d. feed means for feeding a gas through the support into the bed to fluidise at least a part of the bed and e. means for preventing feeding of gas through one part of the support into the bed while gas is fed through another part of the support into the bed, f. whereby a general flow of particles along a circulatory path in the bed can be established.

8. Apparatus according to claim 7 wherein the support includes a portion which is at least approximately concave and which slopes downwardly towards said one part of the support.

9. A method of operating apparatus in which refuse of other combustible material is burned in a fluidised bed and which comprises a heat exchanger assembly, wherein during the starting of the bed from cold, contact between the heat exchanger assembly and fluidised particles of the bed is prevented and, subsequently, particles from the bed are caused to flow into contact with the heat exchanger assembly and heat is extracted from the particles.

10. A method according to claim 9 wherein there is established a general flow of particles along a circulatory path within the bed.

11. Apparatus comprising:

a. a combustion chamber, b. a support adapted to support a bed of particles in the combustion chamber and to admit gas to the bed so that the bed can be fluidised, c. first discharge means for discharging non-gaseous material into a local region of the bed, d. second discharge means for discharging solids from the bed, e. feed means for mixing a gaseous fuel and air and feeding the mixture into the bed through said support at a rate such as to fluidise at least a part of the bed, f. a part of said support which lies directly below said region of the bed and through which fluidising gas can be admitted selectively, and g. control means for controlling flow of fluidising gas through said part of the support, the control means being settable in a first condition to establish such flow and in a second condition to prevent such flow, whereby a general flow of particles along a circulatory path in the bed can be established by preventing the flow of fluidising gas through said part of the support and feeding fluidising gas through the remainder of the support, said circulatory path including a descending portion which leads from said region of the bed towards said part of the support.

12. Apparatus comprising:

a. a combustion chamber, b. a support adapted to support a bed of particles in the combustion chamber and to admit gas to the bed so that the bed can be fluidised, c. first discharge means for discharging non-gaseous material into the bed, d. second discharge means for discharging solids from the bed, and e. feed means for mixing a gaseous fuel and air and feeding the mixture into the bed through said support at a rate such as to fluidise at least a part of the bed, wherein the support presents towards the bed a surface which is at least approximately concave and the lowest part of said surface lies directly below the first discharge means.

* * * * *